United States Patent [19]

Craddock

[11] Patent Number: 4,745,864

[45] Date of Patent: May 24, 1988

[54] EXPLOSIVE FRAGMENTATION STRUCTURE

[75] Inventor: Gerald G. Craddock, Arlington, Tex.

[73] Assignee: LTV Aerospace & Defense Company, Dallas, Tex.

[21] Appl. No.: 99,887

[22] Filed: Dec. 21, 1970

[51] Int. Cl.[4] ..... F42B 13/18

[52] U.S. Cl. ..... 102/491; 102/493

[58] Field of Search ..... 102/67, DIG. 2, 491–493

[56] References Cited

U.S. PATENT DOCUMENTS

| | | | |
|---|---|---|---|
| 3,447,463 | 6/1969 | Lavine | 102/492 |
| 3,491,694 | 1/1970 | Fountain | 102/493 |
| 3,566,794 | 3/1971 | Pearson et al. | 102/493 |

FOREIGN PATENT DOCUMENTS

| | | | |
|---|---|---|---|
| 778900 | 7/1957 | United Kingdom | 102/493 |

*Primary Examiner*—Ted L. Parr

*Attorney, Agent, or Firm*—J. M. Cate; S. S. Sadacca

[57] ABSTRACT

An explosive, fragmentation structure having means for selectively controlling fragment size and configuration. The structure includes an outer casing having an inner surface defining a chamber and further includes means for propagating shock waves across the inner surface from a selected one of two detonation points with the chamber. Means are provided for directing shock waves, propagated from the first detonation point, against the surface in a first pattern of segment-defining lines and for directing shock waves, propagated from the second detonation point, against the surface in a second pattern of lines which define segments larger than those of the first pattern.

15 Claims, 2 Drawing Sheets

FIG 1
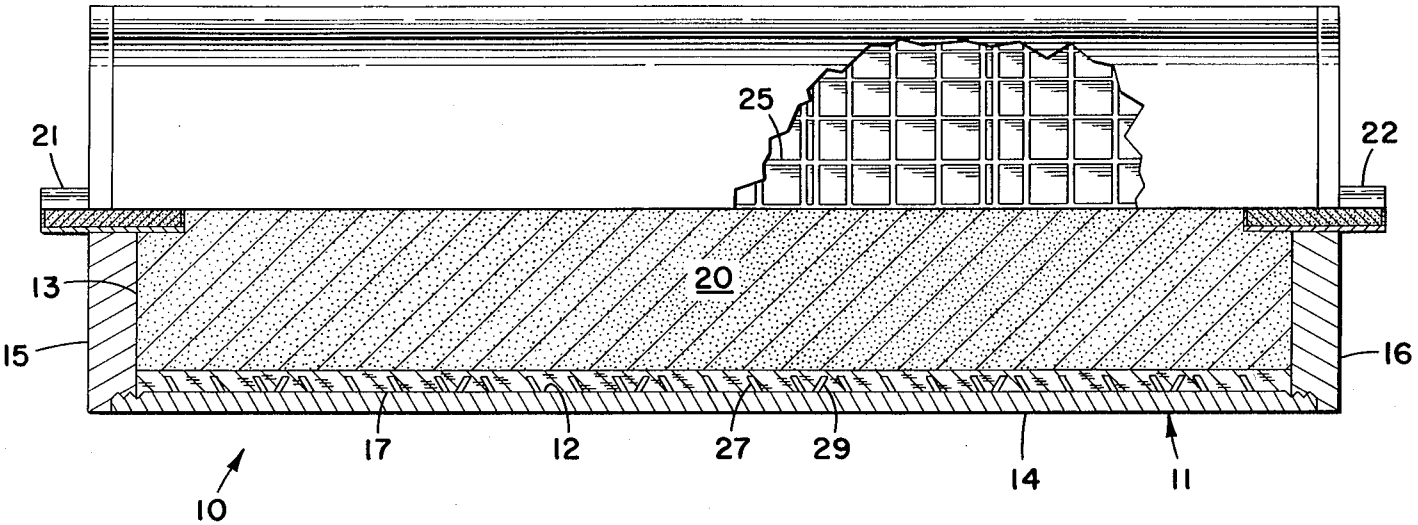
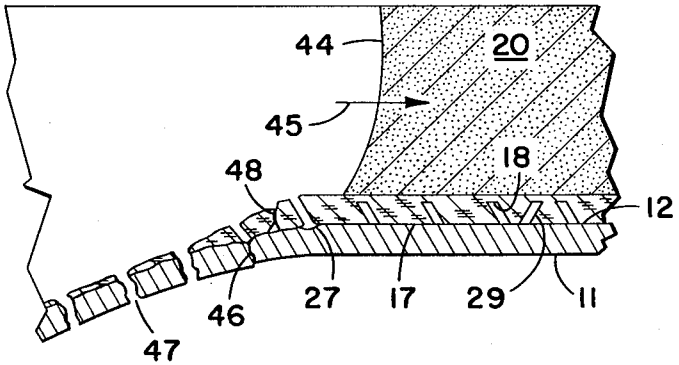
FIG 3
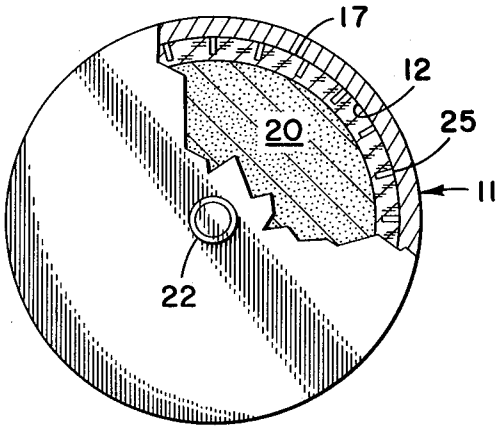
FIG 2

FIG 4
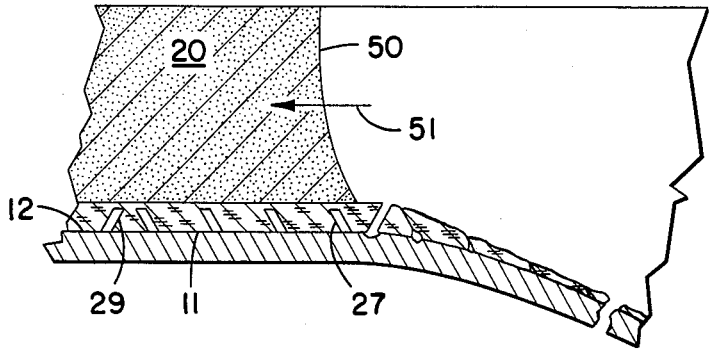
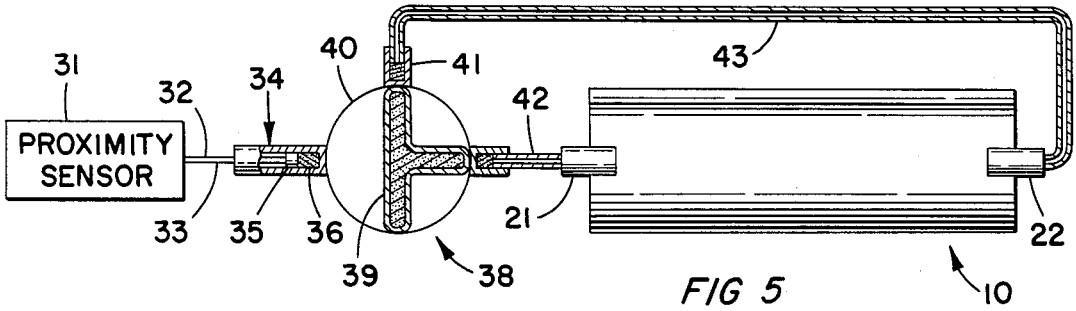
FIG 5
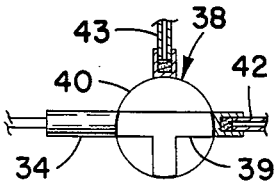
FIG 6
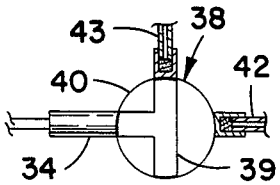
FIG 7
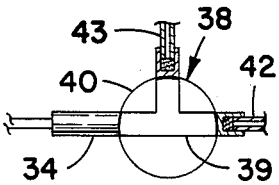
FIG 8
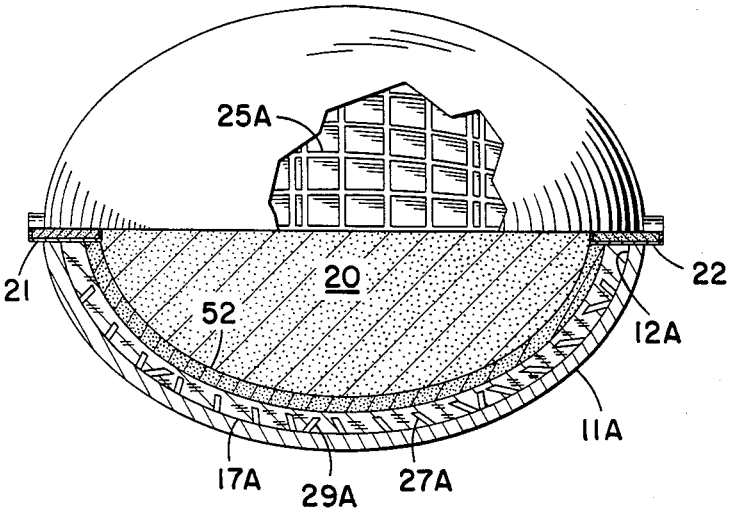
FIG 9

EXPLOSIVE FRAGMENTATION STRUCTURE

This invention relates to a fragmentation structure and, more particularly, to a fragmentation structure having means for selectively controlling the size of fragments produced.

Fragmentation structures, such as fragmentation warheads, mines, etc., are employed by the military against a wide variety of targets where dispersion of fragments over a target area is required. A problem which arises in their use is that fragmentation warheads suitable for use against personnel are generally not suitable for use against "hard" targets such as armored vehicles and emplacements, where fragments of relatively greater size and mass are required. Military units have therefore been required to maintain supplies of several types of fragmentation warheads, each type adapted for use against a particular type of target. This results in an increased burden of logistics and supply and is, of course, highly undesirable. In the past, it has been attempted to minimize this problem by constructing warheads having two sections, one section being adapted to disperse fragments of one size and the other being adapted to disperse fragments of another size. In this manner, a single warhead may be utilized against a variety of targets. Such a construction, however, is inefficient in that, in each case, portions of the warhead not designed for the particular application are largely ineffective; furthermore, in order to produce a given amount of destructive force, a warhead of larger dimensions is necessary than would be the case for one designed for the specific application.

Other problems related to the construction of fragmentation warheads have involved the expense of machining or casting a multiplicity of grooves or openings in the metal casings to induce fragmentation of the casing in a desired pattern by establishing preferential fracture lines. Alternatively, an inner casing having openings or grooves formed therethrough is disposed within an outer metal casing and configured such that it directs explosive shock waves from an internal explosive charge against the outer casing in a grid-like pattern, such that the outer casing is fractured along the grid lines. In all cases, the molding, machining, or forging of metal structures into a desired, grid-like pattern is undesirably expensive, particularly when large quantities of weapons are to be manufactured. A further, related problem present with any explosive device is the danger of accidental detonation of the explosive charge by either mechanical shock or heat. Under combat conditions, for example, stored ammunition may be jarred by incoming rounds or careless handling, or it may be heated by fires started by incoming rounds. In any case, it is desirable that the ammunition be as resistant as possible to such heat and shock.

It is, accordingly, a major object of the present invention to provide a new and improved fragmentation structure.

Another object is to provide such a fragmentation structure which may be programmed to disperse into fragments of a selected one of two sizes as desired for a particular target.

A further object is to provide such a fragmentation structure which is resistant to accidental ignition by heat or mechanical shock.

Yet another object is to provide a fragmentation structure having the above-stated advantages which, nonetheless, is of less expensive and more practicable construction than prior devices.

Other objects and advantages will become apparent from the specification and claims and from the accompanying drawings illustrative of the invention.

In the drawings:

FIG. 1 is a longitudinal, partially sectional, plan view of one embodiment of a fragmentation warhead constructed according to the present invention and having portions cut away for greater clarity;

FIG. 2 is an end view, partially cut away, of the structure of FIG. 1;

FIG. 3 is a longitudinal, sectional view of a portion of the fragmentation device of FIG. 1 showing the effects of a first detonation shock wave;

FIG. 4 is a view, similar to FIG. 3 showing the effects of a second detonation shock wave;

FIG. 5 is a diagrammatic representation of the structure of FIG. 1 and of apparatus, including an arming mechanism, for selectively detonating a respective one of the detonation charges;

FIG. 6 is a diagrammatic representation of the arming mechanism of FIG. 5 in a first position;

FIG. 7 is a view, similar to FIG. 6, showing the arming mechanism in a second position;

FIG. 8 is a view similar to FIGS. 6 and 7 and showing the arming mechanism in a third position; and FIG. 9 is a view, similar to FIG. 1, of a warhead illustrative of a second embodiment of the invention.

With reference now to FIG. 1, a preferred embodiment of the explosive structure includes an explosive warhead 10 of cylindrical configuration, the warhead having an outer casing structure 11 of substantially cylindrical configuration and having an inner surface 12 defining a chamber 13. The casing structure 11 may be of integral construction or, as in the present embodiment, may be comprised of a tubular body 14 having first and second end portions closed, respectively, by first and second, disc shaped, end pieces 15, 16 each disposed perpendicularly of the tubular body 14. The end pieces 15, 16 are suitably threadingly connected to the end portions of the tubular body 14 upon internal threads formed within the respective end portions, as shown, or are otherwise rigidly affixed to the respective end portions. A layer of material 17 is mounted within the casing structure 11 adjacent at least a portion of the inner surface 12; in the present embodiment, the layer 17 is of tubular configuration and lines the inner surface of the tubular body 14. The layer of material 17, hereinafter termed the liner 17, is preferably of a material more compressible than the material of the outer casing structure 11 and is suitably formed of high density cork, the outer casing structure 11 preferably being formed of steel. Means for propagating shock waves across the inner surface 12 and within the chamber 13 from a selected one of at least first and second locations, or detonation points, within the casing structure 11 are provided and, in the present embodiment, include an explosive charge 20, of a secondary high explosive as typically used in military warheads, substantially filling the cavity enclosed by the liner 17 and the end pieces 15, 16. The means for propagating shock waves further comprises first and second detonation charges 21, 22 suitably comprising first and second, conventional blasting caps respectively positioned coaxially of the first and second end pieces 15, 16 and extending through suitable bores formed through the respective end pieces 15, 16.

In the present, cylindrically configured embodiment, a first plurality of slots or grooves, termed, hereinafter, first grooves 25, are formed at least substantially through the liner 17 from its external surface. That is, the grooves 25 are cut substantially through, or, alternatively, completely through the liner 17. Preferably, the grooves 25 (as well as the second and third grooves 27, 29 to be described) are cut deeply enough to leave only a thin layer 18 (FIG. 3) of lining material on the inner side of the liner 17 for retaining the material of the explosive charge 17 in compacted, cylindrical configuration and thus preventing it from loosening, falling into the grooves 25, and becoming nonuniform. Alternatively, if the first grooves 25, and the second and third grooves 27, 29 (described below) are formed completely through the liner 17, in which case the liner comprises a plurality of segments of liner material, these segments are preferably bonded to an additional, inner tube (not shown) of a thin sheet of a material such as metal foil, cardboard, or plastic for ensuring proper spacing of the segments of lining material and for containing the material of the explosive charge 20.

The first grooves 25 extend, in approximately mutually parallel relationship, longitudinally of the casing structure 11 or such that each first groove 25 extends approximately in a respective plane coincident with an axis intersecting the first and second detonation charges 21, 22 (e.g., the central, longitudinal axis of the casing structure 11). With added reference to FIG. 2, the first grooves 25 are of greater depth than width and are cut approximately perpendicularly into the outer surface of the liner 17 and such that the sidewalls of each of the first grooves 25 are substantially radially oriented with respect to the axis bisecting the two detonation charges 21, 22. A second plurality of slots or grooves 27, termed second grooves 27, is similarly provided, the second grooves 27 being cut at least substantially through the liner 17 and also extending in approximately mutually parallel relationship. The second grooves 27 cross the first grooves 25 at approximately right angles and thus, in the present embodiment, extend circumferentially of the liner 17. The second grooves 27 are mutually spaced along the longitudinal axis of the casing structure 11 and, in cross section, are each inclined toward the first detonation charge 21. That is, in the present embodiment, each respective second groove 27 is inclined toward the first detonation charge 21 with respect to a plane intersecting the respective second groove 27 and extending perpendicularly of an axis which intersects both detonation charges 21, 22. Each second groove 27 is inclined from such a perpendicular plane by at least 10°, and preferably by about 20°. A third plurality of grooves or slots, termed third grooves 29, are also similarly cut at least substantially through the liner 17, the third grooves 29 also crossing the first grooves 25 at approximately right angles and extending circumferentially of the liner 17. These third grooves 29 are also mutually spaced along the length of the casing structure 11 but are spaced farther apart than the second grooves 27. The third grooves 29 are cut into the liner 17 as are the second grooves 27, but are inclined in an opposite direction, or toward the second detonating charge 22, for reasons which will become apparent. It will thus be seen that the second grooves 27 cross the first grooves 25 at approximately right angles to form a first pattern of segment-defining lines which define segments of approximately rectangular configuration. Similarly, the first grooves 25 cross the third grooves 29 to form a second pattern of segment-defining lines, but form segments of greater elongation and area than those of the first pattern, in that the third grooves 29 are spaced farther apart than the second grooves 27.

With reference now to FIG. 5, apparatus for detonating a selected one, or both, of the detonating charges 21, 22 is diagrammatically shown with respect to application of the warhead 10 in a missile (not shown) adapted to detonate at a preselected distance from a target. A proximity sensing circuit 31 of the type adapted to emit an electrical signal upon reaching a predetermined distance from a target is connected, through first and second conductors 32, 33, to an electric detonator 34. The electric detonator 34 is of the well-known type employing a bridge wire (not shown) connected across the conductors 32, 33 and operable to ignite a primary explosive charge 35 positioned adjacent a secondary charge 36. Positioned adjacent the secondary charge 36 of the electric detonator 34 is an arming mechanism 38 of the general type commonly employed in explosive devices, known in the art as "safety and arming" mechanisms, and employing a rotatable member which is rotatable from a "safe" position to an "armed" position in which the explosive device may be detonated. In the present arming mechanism 38, an explosive lead 39 of T-shaped configuration is mounted upon a rotatable element, represented diagrammatically by the circle 40, and positioned between the electric detonator 34 and first and second detonating cords 42, 43 extending, respectively, to the first and second detonation charges 21, 22. The detonator 34, first detonation cord 42, and second detonation cord 43 extend radially toward the arming mechanism 38 from nine, three, and twelve o'clock directions respectively, as viewed in the drawing. Such detonating cords 42, 43 are commonly used in the art and employ a length of tubular material coaxially containing a length of rapidly detonating explosive. Such detonation cord is manufactured by E. I. du Pont de Nemours and Co. under the trade name "Primacord". In use, the detonating cord is normally terminated adjacent an additional, primary explosive charge 41 facing the arming mechanism 38 for ensuring ignition of the cord. The T-shaped explosive lead 39 of the arming mechanism 38 has its head and stem portions radially oriented on the rotatable member 40 and, in FIG. 5, is in a "safe" position in which the head portion of the "T" is positioned vertically, as viewed in the drawing, and is isolated from the electric detonator 34. With reference to FIG. 6, the rotatable member 40 has been rotated 90° from its safe position in a clockwise direction, as viewed, to a first, armed position in which the head portion of the T-shaped explosive lead 39 extends horizontally and is in register with the electric detonator 34 and the first detonation cord 42. A continuous explosive train now exists between the electric detonator 34 and the first detonation charge 21. Upon the rotatable member 40 being further rotated 90° in a clockwise direction to a second armed position, as shown in FIG. 7, a continuous explosive train extends to the second detonation charge 22. Finally, upon the rotatable member 40 being further rotated by 90° to a third armed position (FIG. 8), a continuous explosive train extends between the electric detonator 34 and both detonation charges 21, 22. The rotatable member 40 is positioned manually, prior to firing, in a selected one of the three armed positions. Alternatively, the positioning of the member 40 is remotely accomplished by means of a servomotor (not shown) drivingly connected to the member 40 and powered by a remotely actuated signal.

In operation, and with added reference to FIG. 1, fragmentation of the outer casing structure 11 is induced in a selected one of the first and second patterns by appropriately oriented detonation wave fronts expanding from the detonation charges 21, 22, as will now be described. Assume, for example, that it is desired to cause fragmentation of the casing 11 along the segment-defining lines of the first pattern, i.e., along the pattern formed by the first and second grooves 25, 27. The rotatable member 40 is positioned in its first position (FIG. 6) and a continuous explosive train is formed between the electric detonator 34 and the first detonation charge 21. In the above described, missile application, upon the warhead 10 reaching the predetermined distance from the target at which detonation is desired, the proximity sensing circuit 31 emits an electrical signal which is conducted by conductors 32 and 33 to the electric detonator 34 and causes sequential detonation of the detonator 34, the explosive lead 39, the first detonating cord 42, the first detonation charge 21, and the explosive charge 20. While the above-described arming mechanism 38 and proximity sensor 31 provide convenience of operation, alternate constructions are also satisfactory. For example, the explosive structure 10 may be employed as an impact detonation warhead 10 wherein a selected one of the detonation charges 21, 22 is oriented in a forward direction, upon firing, and is detonated upon its impact against a target, the charges 21, 22 (in such case) being impact-sensitive.

Detonation of the explosive charge 20 (FIG. 1) by the first detonating charge 21 produces a detonation shock wave which passes radially outwardly from the first detonation charge 21, through the explosive charge 20, and along the length of the casing structure 11 from the first detonation charge 21 to the second end piece 16. The rapidly expanding detonation shock wave thus passes across the liner 17 and the inner surface 12 of the casing structure 11. With added reference now to FIG. 3, an advancing, first detonation wave front propagated from the first detonation charge 21 is diagrammatically represented by the line 44 and rapidly moves in the direction represented by arrow 45. The representative, second groove 27 is inclined toward the first detonation charge 21 and thus, toward the advancing wave front 44. Thus, the wave front 44 is received and directed through the second grooves 27 toward the casing structure 11. The detonation wave front 44 is of an energy level such that it quickly penetrates any thin portion 18 of the liner 17 remaining across the grooves 25, 27, 29 and adjacent the explosive charge 20. Thus, the second grooves 27 are adapted to receive and direct the advancing detonation wave front 44 toward the outer casing structure 11; similarly, the first or longitudinal grooves 25 (FIGS. 1 and 2) receive and direct the wave front 44 toward the outer casing structure 11, because they are positioned in a radially oriented configuration, open to the advancing wave front 44, and through which the advancing wave front 44 may easily pass, the direction of movement of the wave front 44 being radially outward from the first detonation charge 21 and along the longitudinal axis of the casing structure 11. For reasons which are not completely understood, the grooves 25, 27, 29 of parallel sidewall construction apparently intensify the effect of the shock waves upon the surface 12 such that a definite deformation of the surface 12 is obtained.

Thus, the first detonation front 44 is directed through the first and second grooves 25, 27 toward and against the inner surface 12 of the tubular body portion 14 of the casing structure 11 in the first pattern of segment-defining lines defined by the first and second grooves 25, 27. The detonation front 44 also impings upon the end pieces 15, 16. In the present embodiment, these end pieces 15, 16 are made of thicker material than the sidewalls of the tubular body 14, however, and are not readily deformed by the detonation of the explosive charge as is the tubular body 14.

With reference to FIG. 3, the portions of the detonation shock wave 44 which are directed through the second grooves 27 and the first grooves 25 (FIGS. 1 and 2) impinge upon the respective, adjacent portions of the inner surface 12 with sufficient force to etch and deform the surface, forming corresponding grooves in the surface 12, and weakening the casing structure 11 along these grooves. A fraction of a second after the passing of the initial, detonation shock wave 44, gasses from the explosive charge 20 expand rapidly under every high pressure, which puts further stress upon the casing structure 11 and expands and separates the casing structure, as shown in FIG. 3. These expanding gasses also put further stress upon the grooved and weakened areas which have been cut along the first and second grooves 25, 27 by the detonation front 44, and these weakened areas act as stress risers to cause the casing structure 11 to crack, as shown at the fragmented portion 46 immediately to the left of the wave front 44, and ultimately, to separate under the force of the expanding gasses as shown at 47. The advancing detonation front 44 strikes the third grooves 29 in a direction athwart the sidewalls of the third grooves 29 rather than at an acute angle, and, because the grooves 29 are of substantially greater depth than width, the wave front 44 is not effectively channeled through the third grooves 29 toward the inner surface 12. Thus, substantially no weakening action is effected against the portions of the inner surface 12 of the casing 11 which are in register with the third grooves 29. In fact, in the present, preferred embodiment wherein the liner 17 is of a relatively compressible material, e.g., of cork, the advancing, detonation wave front 44 and the expanding detonation gasses tend to compress the liner 17, as shown by the compressed third groove 48, such that the expanding gasses are prevented from passing through the third grooves. The compressible liner 17 thus acts as a means for preventing fragmentation of the casing 11 in the second pattern or along the third grooves 29. Materials ordinarily considered relatively non-compressible, such as aluminum, iron, or plastics, can also be used, however.

Alternatively, if it is desired to fragment the casing structure 11 into larger fragments as defined by the second pattern (formed by the first and third grooves 25, 29), the explosive charge 20 is detonated by the second detonation charge 22 such that an oppositely directioned, second detonation shock wave 50 (FIG. 4) is produced with is propagated radially outwardly from the second detonation charge 22 (FIG. 1) and thus passes from the second charge 22 toward the first end portion 15, or from right to left as viewed in the drawing and as shown by arrow 51. The second detonation shock wave 50 is directioned through the first and third grooves 25, 29 but is largely prevented from passing through the second grooves 27, according to the same principal described above with respect to the first shock wave 44 of FIG. 3; and thus, the casing structure 11 is fragmented along the second pattern of lines such that elongated fragments of a larger area are produced. Accordingly, the first and second grooves 25, 27 comprise a first means for directing shock waves, propagated from the first detonation charge 21, against at least a selected portion (i.e., the portion covered by the liner 17) of the inner surface 12 in a first pattern of segment-defining lines for scoring and weakening the casing along the first segment-defining lines, and the first and third grooves 25, 29 comprise a means for directing shock waves, propagated from the second detonation charge 22, against the selected inner portion of the inner surface 12 in a second pattern of segment-defining lines which are larger than the segments of the first pattern. Alternatively, the grooved liner 17 is extended over the end portions 15, 16 to cause fragmentation of these portions also if desired. However, complete selectivity of operation may not be practicable with respect to the end pieces 15, 16. For example, a detonation shock wave propagated from the second detonation charge 23 impinges upon the first end piece 15 substantially perpendicularly and penetrates all grooves formed in lining material covering the first end piece 15. If it is desired to fragment the casing structure 11 into a combination of large and small fragments, the rotatable member 40 of the arming mechanism 38 (FIG. 5) is initially positioned in its third armed position as shown in FIG. 8, whereupon both detonation charges 21, 22 are detonated upon activation of the fuze 34. By constructing the first and second detonation cords 42, 43 of equal lengths, substantially simultaneous detonation of the charges 21, 22 is obtained, and a combination of large and small fragments is produced. Moreover, it will be apparent that various combinations of large and small fragments can be obtained by varying the relative lengths of the first and second detonation cords 42, 43.

It can thus be seen that the described structure provides a means for selectively producing either large or small fragments from a single warhead, yet remains of relatively simple and practicable construction, requiring no complex machining of metal parts. The larger, elongated fragments produced by detonation of the second detonation charge 22 are effective where greater penetrating power is desired, in that at least some of these fragments will be driven against the target in a substantially axial direction, or as an impinging arrow, such that greater kinetic energy per unit area is expended against the target. The elongated fragments are thus adapted for effective use against armored vehicles or emplacements.

While the explosive structure has thus far been described with reference to a warhead 10 having a substantially cylindrical configuration, further embodiments are possible utilizing the inventive concept, provided that the grooves of the first pattern include some grooves which are open to and adapted to receive detonation shock waves propagated from a first detonation charge only, and that the grooves of the second, segment-defining pattern include some grooves which are adapted to receive detonation shock waves propagated from the second detonation charge but which are not responsive to those from the first detonation charge. For example, and as shown in FIG. 9, a casing structure 11A of ellipsoidal configuration may be employed, also utilizing first and second detonation charges 21, 22 mounted in opposite end portions of the casing structure. First, longitudinal grooves 25A extend lengthwise of the casing structure 11A, i.e., the first grooves 25A are intersected by respective planes which are coincident with a central axis intersecting both the first and second detonation charges 21, 22 respectively, as in the cylindrical structure described above. Second and third grooves 27A, 29A are cut circumferentially into the liner 17A in a similar fashion to that described with respect to those of the first, cylindrical embodiment, and are respectively sloped, in cross section, toward the first and second detonation charges 21, 22 with respect to the inner surface 12A of the casing structure 11A. That is, with respect to a respective plane extending tangentially of the inner surface 12A at its intersection with a respective one of the second grooves 27A, the respective second groove 27A is inclined, from perpendicular to the tangential plane, toward the first detonation charge 21, and any respective third groove 29A is oppositely sloped, with respect to a corresponding, respective, tangential plane, toward the second detonation charge 22. The above-described, ellipsoidal configuration may be detonated as was described with respect to the cylindrical embodiment, or a further means for propagating the initial shock waves may be provided by the use of a detonation layer 52 formed of a sheet of explosive having a detonation velocity substantially greater than that of the main detonation charge 20. The detonation layer 52 is mounted within the casing structure 11A and liner 17A, adjacent the inner surface of the liner 17A and between the liner and the explosive charge 20. Upon detonation of the first detonation charge 21, for example, detonation of the layer 52 is initiated at its portion most closely adjacent the first detonation charge, and a detonation shock wave propagates through the detonation layer 52 outwardly from the first detonation charge 21. This detonation shock wave is received by and conducted through the first and second grooves 25A, 27A in the same manner as was the first detonation wave 44 (FIG. 3) of the cylindrical embodiment because the first and second grooves 25A, 27A are directioned toward the advancing shock wave. The first and second grooves 25A, 27A direct the shock wave against the inner surface 12A in a first pattern of segment-defining lines, scoring and weakening the casing structure 11A along these lines as in the first embodiment. Detonation of the main explosive charge 20 is also initiated by the first detonation charge 21, and the main explosive 20 then acts to fragment the casing along the first pattern of segment-defining lines produced by the detonation shock wave initially propagated by the detonation layer 52.

Thus, in either configuration, an explosive warhead structure of the fragmentation type is taught which provides selectivity with respect to fragment size, thus providing the advantage of effectiveness against a wide variety of targets while avoiding the necessity of supplying and transporting fragmentation structures of different constructions appropriate for differing targets. Substantially all of the casing structure is fragmented into fragments of selected size, as contrasted to prior, compromised designs in which, for example, half the structure fragments into relatively small fragments and half into larger fragments. A further advantage is that the liner 17, if made of a compressible material as described, insulates the explosive charge 20 against accidental detonation by either heat or mechanical shock to the casing. The fragmentation structure also provides the well-known advantages obtained by the use of a non-scored casing structure, i.e., the casing structure is not weakened, during its manufacture, by scoring, and the expense of machining or otherwise forming grooves in a metal casing structure is avoided. Moreover, in addition to providing the above-cited advantages, the fragmentation structure is also of practicable and economical construction.

While only one embodiment of the invention, together with modifications thereof, has been described in detail herein and shown in the accompanying drawing, it will be evident that various further modifications are possible in the arrangement and construction of its components without departing from the scope of the invention.

What is claimed is:

1. An explosive structure of the fragmentation type, comprising:

an outer casing having an inner surface defining a chamber;

means for propagating shock waves across the inner surface from a selected one of at least first and second detonation points within the casing;

first means directing shock waves, propagated from the first detonation point, against at least a selected portion of the inner surface in a first pattern for scoring and weakening the casing along first, segment-defining lines;

second means directing shock waves, propagated from the second detonation point, against the selected portion of the inner surface in a second pattern for scoring and weakening the casing along second, segment-defining lines, the segments of the second pattern being larger than the segments of the first pattern; and means for fragmenting the casing along the resulting, segment-defining lines scored in the casing.

2. The structure recited in claim 1, wherein the means for fragmenting the casing comprises an explosive charge contained within the outer casing, and wherein the means for propagating shock waves across the inner surface comprises at least two detonating charges respectively positioned within the casing at the first and second detonation points.

3. The structure of claim 2, wherein the first and second directing means include a layer of material lining at least the selected portion of the inner surface of the outer casing and enclosing the explosive charge and wherein the first directing means comprises grooves formed in the layer of material and opening at least toward the outer casing, at least some of the grooves, in cross section, being inclined, with respect to the adjacent inner surface of the casing, toward the first detonation point for passing detonation shock waves, propagated from the first detonation point, to the outer casing, and wherein the second directing means comprises grooves formed in the layer of material and opening at least toward the outer casing, at least some of the grooves of the second directing means being inclined, in cross section and with respect to the adjacent inner surface of the casing, toward the second detonation point for passing detonation shock waves, propagated from the second detonation point, to the outer casing.

4. The structure of claim 3, wherein the lining material is more compressible than the material of the outer casing.

5. The structure of claim 4, wherein the means for propagating shock waves across the inner surface further comprises a layer of explosive material positioned between the layer of lining material and the explosive charge and substantially covering the layer of lining material, the explosive layer being of an explosive material having a detonating speed substantially greater than that of the explosive charge, the detonating charges being mounted adjacent the layer of explosive material, whereby detonation of either of the detonating charges detonates the explosive layer, which produces a detonation shock wave which propagates through the explosive layer and is directed through the respective one of the patterns of grooves in which grooves are inclined toward the respective detonation charge for scoring and weakening the outer casing, and whereby detonation of the explosive charge, at a slower rate, is also initiated by the respective detonating charge for fragmenting the casing.

6. An explosive structure of the fragmentation type, comprising:

an outer casing having an inner surface defining a chamber;

an explosive charge immovably located within the chamber;

means for detonating the explosive charge at a selected one of first and second, mutually spaced detonation points within the chamber for producing, upon detonation of the charge at the first detonation point, a detonation shock wave propagating from the first detonation point and, upon detonation of the charge at the second point, a detonation shock wave propagating from the second point;

a layer of material lining at least a selected portion of the casing inner surface;

first directing means, responsive to detonation shock waves propagated from the first detonation point, for directing portions of a detonation shock wave, propagated from the first detonation point, toward the outer casing in a first pattern of segment-defining lines for scoring and weakening the casing along the segment lines to permit fragmentation of the casing along the segment lines by expanding gasses from the explosive charge; and second directing means, responsive to detonation shock waves propagated from the second detonation point, for directing portions of a detonation shock wave, propagated from the second detonation point, toward the outer casing in a second pattern of segment-defining lines for scoring and weakening the casing along the segment-defining lines of the second pattern to permit expanding gases from the explosive charge to fragment the outer casing along the lines of the second pattern, the segments of the second pattern being larger than the segments of the first pattern.

7. The structure of claim 6, wherein the first directing means also comprises a means for preventing fragmentation of the casing in the first pattern by shock waves propagated from the second detonation point and wherein the second directing means also comprises a means for preventing fragmentation of the casing in the second pattern by shock waves propagated from the first detonation point.

8. The structure of claim 7, wherein the lining material is a material more compressible than the material of the outer casing.

9. The structure of claim 7, wherein the first directing means comprises slots, of greater depth than width, formed substantially through the layer of lining materal and opening at least toward the outer casing, the slots being configured in the first pattern, and wherein the second directing means comprises slots, of greater depth than width, formed into the layer of lining material and opening at least toward the outer casing and configured in the second pattern.

10. The structure of claim 9, wherein at least some of the slots of the first directing means comprise slots which, in cross section, are inclined, with respect to an axis intersecting the first and second detonation points, toward the first detonation point, and wherein at least some of the slots of the second directing means comprise slots which, in cross section, are inclined, with respect to the axis intersecting the first and second detonation points, toward the second detonation point.

11. The structure of claim 10, wherein the first and second directing means further comprise slots which respectively lie approximately in respective planes coincident with an axis intersecting the first and second detonation points.

12. An explosive structure of the fragmentation type, comprising:

an outer casing having an inner surface defining a chamber;

a layer of material lining the inner surface of the casing and enclosing an inner cavity;

an explosive charge immoveably contained within the inner cavity;

means for detonating the explosive charge at a selected one of first and second, mutually spaced detonation points within the casing chamber; and slots formed at least substantially through the layer of lining material and opening at least toward the outer casing, the slots being of greater depth than width and including a first plurality of slots which extend in approximately mutually parallel relationship, a second plurality of slots extending in approximately mutually parallel relationship and crossing the slots of the first plurality of slots, each of the second plurality of slots being spaced along the liner between the two detonation points, and a third plurality of slots which extend in approximately mutually parallel relationship and also cross the first plurality of slots, the slots of the third plurality of slots being spaced a greater distance apart than the slots of the second plurality of slots, the slots of the second plurality of slots each being inclined, with respect to the respective adjacent portion of the inner surface of the outer casing, toward the first detonation point, and the third plurality of slots each being inclined toward the second detonation point.

13. The apparatus of claim 12, wherein the lining material is of a more compressible material than the outer casing.

14. An explosive structure of the fragmentation type comprising:

an elongated casing having first and second, opposite end portions and having first and second, detonation means mounted, respectively, within the first and second end portions;

a liner mounted within the outer casing, covering the inner surface thereof and enclosing an inner cavity;

an explosive charge substantially filling the cavity;

a first plurality of longitudinal grooves, extending approximately parallel to the longitudinal axis of the casing, formed in the liner;

a second plurality of grooves, formed in the liner, crossing the longitudinal grooves, and spaced along the length of the casing, the second plurality of grooves being inclined toward the first detonation point; and a third plurality of grooves, formed in the linar, crossing the longitudinal grooves, and spaced along the longitudinal axis of the casing by a greater distance than the second plurality of grooves, the third plurality of grooves being inclined toward the second detonation point.

15. The structure of claim 14, wherein the casing is of substantially cylindrical shape and wherein the grooves of the first and second pluralities of grooves are respectively inclined, with respect to the longitudinal axis of the casing, by at least 10 degrees from normal.

* * * * *